United States Patent [19]

Wulf et al.

[11] Patent Number: 4,837,945

[45] Date of Patent: Jun. 13, 1989

[54] DRYER, PARTICULARLY FOR THE CHEMICAL INDUSTRY

[75] Inventors: Gunter Wulf, Wangen; Heinz Geisenhof, Weissenberg, both of Fed. Rep. of Germany

[73] Assignee: Hermann Waldner GmbH & Co., Fed. Rep. of Germany

[21] Appl. No.: 108,140

[22] Filed: Oct. 13, 1987

[30] Foreign Application Priority Data

Nov. 5, 1986 [DE] Fed. Rep. of Germany ..... 3637737

[51] Int. Cl.[4] ..... F26B 21/06

[52] U.S. Cl. ..... 34/77; 34/196; 34/204

[58] Field of Search ..... 34/77, 196, 204

[56] References Cited

U.S. PATENT DOCUMENTS

| | | | |
|---|---|---|---|
| Re. 31,633 | 7/1964 | Lewis | 34/77 X |
| 3,190,011 | 6/1965 | Shields | 34/77 |
| 3,831,294 | 8/1974 | Freze | 34/77 X |
| 4,196,526 | 4/1980 | Berti | 34/77 |
| 4,322,204 | 3/1982 | Voegtlin et al. | 34/204 X |
| 4,471,537 | 9/1984 | Meda | 34/77 |

FOREIGN PATENT DOCUMENTS 0060212 9/1982 European Pat. Off. .

*Primary Examiner*—Steven E. Warner

*Attorney, Agent, or Firm*—Silverman, Cass, Singer & Winburn, Ltd.

[57] ABSTRACT

A dryer having a drying chamber and an inlet housing structure wherein a heating device is located in the inlet housing structure. An outlet structure is provided with a main chamber and a secondary chamber wherein the flow of gas exiting the drying chamber is divided into a main flow of gas passing from the main chamber to the inlet housing structure and a secondary flow of gas passing from the secondary chamber past a condenser which is located in the secondary chamber to the inlet housing structure. Side chambers located in the housing have side walls which are formed from a perforated sheet of metal. The dryer will function in a recycled-air operation as well as a fresh-air operation.

10 Claims, 2 Drawing Sheets

DRYER, PARTICULARLY FOR THE CHEMICAL INDUSTRY

BACKGROUND OF THE INVENTION

The invention relates to a dryer and more particularly to a dryer for the chemical industry which functions to allow both fresh air operation and return air operation.

One prior art dryer is disclosed in European Pat. No. 60,212. The prior art dryer has a very complicated structure and is difficult to use. In the prior art arrangement, a fan basket in the ceiling part of the housing extends directly into the drying chamber and draws off the flow of gas from the chamber. On the exhaust side, the fan basket in the ceiling part directs the flow of gas as a main flow along the back wall of the drying chamber, where a heating device is located, and down past the division plate to the back side of a loading car that is located in the drying chamber. The main flow of gas then passes through the loading car in the longitudinal direction. The ceiling part of the chamber on the exhaust side has a control device which directs a secondary flow along the side walls and into the drying chamber where condensers are located. The secondary flow is suctioned back by a fan on the suction side of the chamber. Since the secondary flow of gas is led directly to the condensers, heat is lost through the fan rather than being absorbed by the material to be dried.

SUMMARY OF THE INVENTION

The above and other disadvantages of the prior art dryers are overcome by providing a dryer which is versatile and energy efficient.

A flow of heated gas is led past material to be dried in a generally laminar flow, without sharp turns, thus efficiently extracting thermal energy from the gas to dry the material. This means a reduction in the amount of energy required for cooling and condensing purposes. Chambers are located on both the exhaust and the inlet or suction sides of the dryer as well as in a housing structure located adjacent to the housing to dampen the flow of gas. Additionally, filters are provided to eliminate particles, such as dust, that may be carried along in the gas flow. A ventilator produces an air flow at the inlet side of the dryer and a lower pressure or vacuum on the suction side of the dryer thus allowing the gas inlets and/or outlets to be located in the inlet and outlet housing structures.

Since the loading car is kept free of baffles, it can be of a very simple construction. It is, preferably, constructed as a framework that is open on all sides. The dryer of the present invention can be utilized with either a closed circuit operation or a fresh air gas fed operation. Controlled amounts of fresh air can be added as required and/or a portion of the flow of gas can be drawn off as exhaust.

DESCRIPTION OF THE PREFERRED EMBODIMENT

Figure 1:
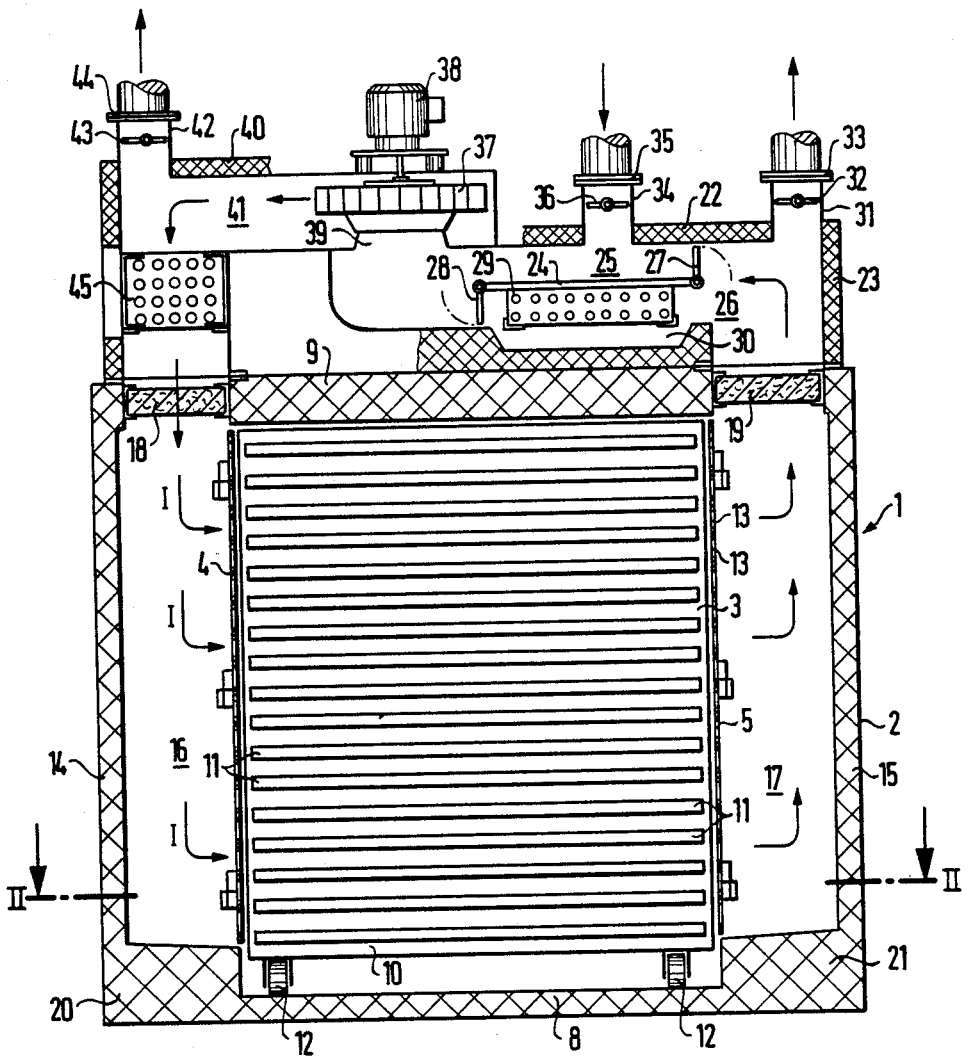
FIG. 1 is a diagrammatic side view of a dryer embodying the present invention.
Figure 2:
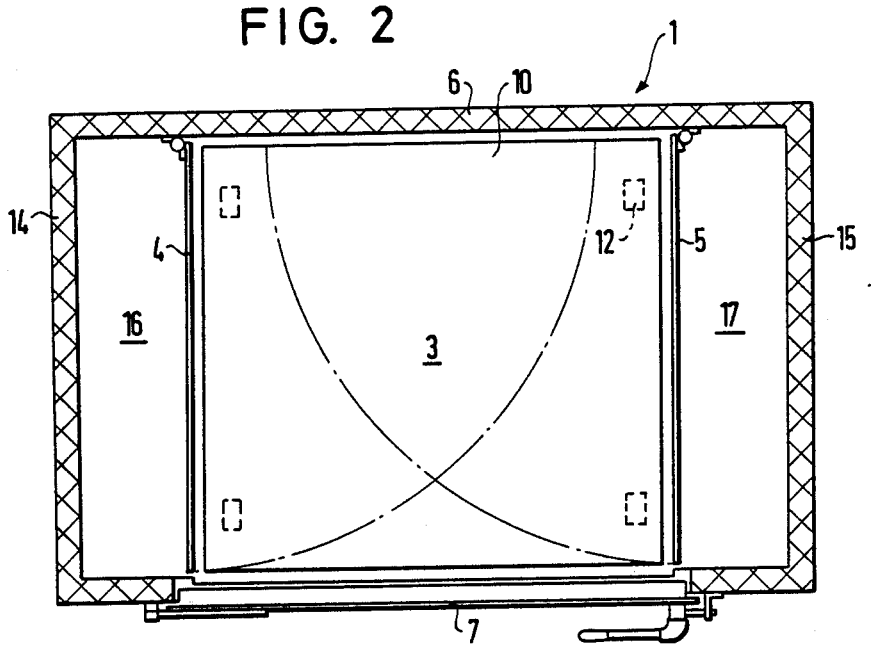
FIG. 2 is a diagrammatic section along the line II—II of FIG. 1 and in the direction indicated generally.
Figure 3:
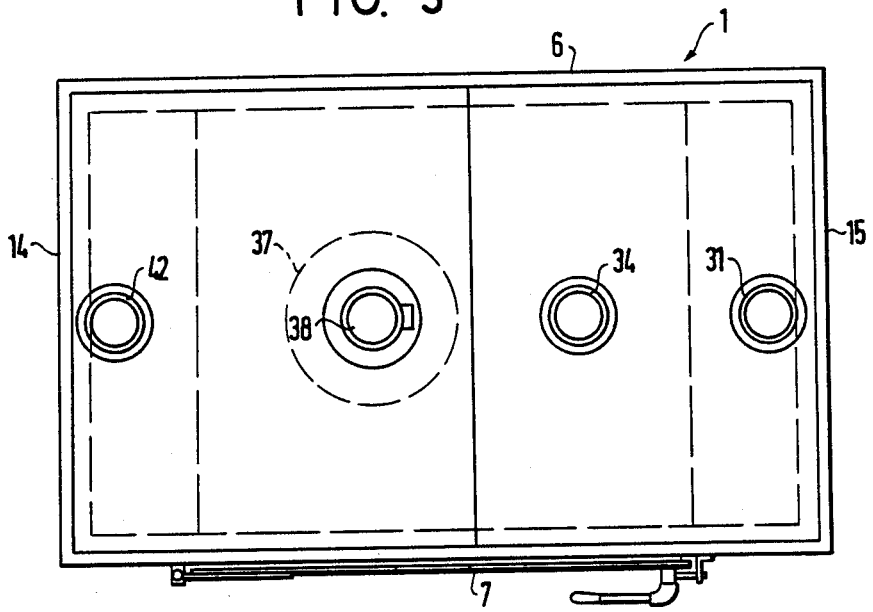
FIG. 3 is a diagrammatic top plan view of the dryer of FIG. 1.

Referring to FIG. 1, a dryer which embodies the present invention is designated by the numeral 1. The dryer 1 has a housing 2 with an approximately square cross-section which encloses an approximately square drying chamber 3. The drying chamber 3 is defined by side walls 4 and 5, a rear wall 6 and a door 7 (best seen in FIG. 3), a floor 8 and a cover 9.

A loading car 10 is loaded into the square drying chamber 3 through the door 7. The car 10 has tiers 11 which are supported by a frame (not shown) between which racks (not shown) containing the products to be dried thereon can be pushed. The dimensions, or at least the side dimensions, of the car 10, shown equipped with rollers 12, are adapted to fit within the drying chamber 3. The car 10 is open at the sides and, preferably, the front and the back are open as well. The drying chamber 3 can be constructed so that it will receive several loading cars 10 wherein the cars can be positioned either one next to the other or one behind the other.

The side walls 4 and 5 of the drying chamber 3 are made of perforated sheets which are attached so that they can swing inward into the drying chamber for cleaning purposes. Perforations 13 are arranged in rows across the width of the side walls 4 and 5 with the rows extending above the height of the loading car 10. The perforations 13 are dimensioned to allow the partial flows of gas, indicated by the arrows I, to pass approximately equally through the loading car 10 in the cross direction.

The side walls 4 and 5 as well as housing sides 14 and 15 form delivery and exhaust chambers 16 and 17. Openings 16*a* and 17*a*, in the chambers 16 and 17, can be fitted with filters 18 and 19, respectively. A plate, perforated plate, or other closure that will cause a laminar flow of gas can be substituted for the filters 18 and 19. The chambers 16 and 17 are closed at the bottom by panels 20 and 21.

The side chambers 16 and 17 (formed by the sides 14 and 15, the side walls 4 and 5, the filters 18 and 19 and the panels 20 and 21) can be constructed as separate modular units or in combination with the drying chamber modules as uniform modules.

A housing cover 22 is fixed on the housing 2. The housing cover 22 is generally formed coextensive with the housing 2. The housing cover 22 has an outlet housing structure 23 that overlaps the filter 19 and the cover 9. The housing structure 23 is divided into a main chamber 25 and a secondary chamber 26 by a horizontal baffle 24. The main chamber 25 is equipped with an adjustable valve 27, located near the opening 17*a*, through which gas flows in the direction of arrow 27*a*. A similar valve can be provided for the secondary chamber 26. In addition, there is an adjustable valve 28 at the exit of the secondary chamber 26.

A condenser 29 is located in a horizontal position in the secondary chamber 26. The condenser 29 has a tubular register through which a coolant can flow. A collecting reservoir 30 is located below the condenser 29 to collect any condensate that forms on the condenser 29.

A gas outlet 31, having a control valve 32, is positioned between the opening 17*a* and the valve 27. When the valves 27 and 28 are in the closed position, the entire flow of gas can be diverted to the outside of the dryer 1 through the outlet 31. An outlet filter 33 can be provided to capture any particles that might be exhausted through the outlet 31.

A gas inlet valve 34 can be equipped with a filter 35 and a control valve 36 to open into the main chamber 25. Fresh air, for "fresh-air operation", can be supplied through the valve 34. The chambers 25 and 26 are associated, on the suction side, with a ventilator formed by a fan basket 37 and a motor 38 to draw gas through an intake 39 in the direction indicated by the arrow 39*a* thus creating a lower pressure in the chambers 25 and 26. The intake of fresh air through the inlet valve 34, in the direction of arrow 34*a*, is adjusted by means of the motor 38.

An inlet housing structure 40, which partly covers the outlet housing structure 23, encloses the fan basket 37 and supports the motor 38. The housing structure 40 is adjacent a pressure chamber (not shown) which expands in relation to the intake 39. The pressure chamber has a heating device (not shown) which is constructed as a tubular register that can be heated by an external source, such as steam. The housing structure 40 has an upward directed gas outlet valve 42 to release gas in the direction indicated by the arrow 42*a*. The structure 40 is further equipped with a control valve 43 and, if desired, with an outlet filter 44.

The dryer 1 can be utilized in a closed circuit operation as well as for an operation that is exclusively fresh air or partial amounts of fresh air. Further, the dryer can utilize inert gases. such as nitrogen, so that the danger of explosion during the drying of, for example, products containing solvents is reduced.

The flow of heated gas passes into the large gas chamber 16 as a laminar flow and is therein divided as it flows through the side wall 4, of perforated sheet metal, to reach the tiers 11 and dry the material placed thereon with an evenly distributed flow of gas. The temperature of the gas flow is reduced as the gas passes over the tiers 11 due to evaporation during the drying process. Further, the filter 19 captures particles, such as dust, that may be carried along with the flow of gas. The filter is constructed to be easily removable so that it can be cleaned or replaced.

Depending on the amount of moisture that has been removed from the material, a secondary flow of gas must be led to the condenser 29. The condensation output is adjusted by means of the control valves 27 and 28. Preferably, the condenser 29 is supplied with a cooling liquid to obtain a preliminary lowering of the gas temperature. The amount of heat generated by the rotation of the fan basket 37 must be taken into account when the heating device is set to a desired temperature. A totally fresh-air operation can be obtained by completely replacing the recirculated air with fresh air through the outlet 31 and the inlet valve 34.

Modification and variations of the present invention are possible in light of the above teachings. The housing 2 and the drying chamber 3 can have a shape other than square, for example rectangular, so long as the herein disclosed flow of gas through the dryer 1 is not unnecessarily restricted. It is therefore to be understood that within the scope of the appended claims, the invention may be practiced otherwise than as specifically described.

What is claimed and desired to be secured by Letters Patent of the United States is:

1. A dryer, particularly for the chemical industry, said dryer comprising:

a housing having a right parallelepipedal drying chamber sized to accommodate a loading car;

a delivery side chamber and an exhaust side chamber in said housing for the delivery and exhaust of a flow of gas through said housing, said side chambers extending substantially along the length of opposite side walls of said drying chamber and having perforations in said walls between said side chambers and said drying chamber to allow gas to flow therebetween;

an inlet housing structure positioned above said drying chamber in communication with the exterior of said dryer, said inlet housing structure located adjacent to and in communication with said delivery side chamber, said housing structure further having a ventilator for introducing a flow of gas to said delivery side chamber;

a heating device positioned in the path of said gas flow;

an outlet housing structure positioned above said drying chamber in communication with the exterior of said dryer, said outlet housing structure located adjacent to and in communication with said exhaust side chamber, said outlet housing structure further in communication with said inlet housing structure, said outlet housing structure having a main chamber and a secondary chamber; and means for directing said flow of gas exiting said drying chamber wherein said flow of gas exiting said drying chamber can be divided by said means for directing into a main flow of gas passing from said main chamber to said inlet housing structure and a secondary flow of gas passing from said secondary chamber past a condenser located in said secondary chamber to said inlet housing structure and wherein said entire flow of gas exiting said drying chamber can be directed by said means for directing to bypass both of said first and second chambers and be passed to the exterior of said dryer.

2. The dryer as defined in claim 1 further providing filters located between said side chambers and said housing structures.

3. The dryer as defined in claim 1 wherein said heating device and said condenser are constructed from a tubular register.

4. The dryer as defined in claim 1 wherein said perforations are configured so that partial flows of gas through said loading car are approximately equal.

5. The dryer as defined in claim 1 wherein said side chambers, said drying chamber, and said housing structures are constructed as modular components.

6. The dryer as defined in claim 1 wherein said inlet housing structure is provided with an adjustable gas outlet and said outlet housing structure is provided with an adjustable gas outlet.

7. The dryer as defined in claim 6 further providing a control valve located in said main chamber such that said gas inlet is positioned after said control valve and said gas outlet is positioned before said control valve.

8. The dryer as defined in claim 6 further providing that said perforated walls swing inward into said drying chamber for cleaning purposes.

9. A dryer, particularly for the chemical industry, said dryer comprising:

a housing having a drying chamber sized to accommodate a loading car;

a delivery side chamber and an exhaust side chamber in said housing for the delivery and exhaust of a flow of gas through said housing, said side chambers having perforations in said walls between said side chambers and said drying chamber to allow gas to flow therebetween, said perforated walls being capable of swinging inward into said drying chamber for cleaning purposes;

an inlet housing structure in communication with the exterior of said dryer, said inlet housing structure located adjacent to and in communication with said delivery side chamber, said housing structure further having a ventilator for introducing a flow of gas to said delivery side chamber, said inlet housing structure being provided with an adjustable gas outlet;

a heating device positioned in the path of said gas flow; and an outlet housing structure in communication with the exterior of said dryer, said outlet housing structure located adjacent to and in communication with said exhaust side chamber, said outlet housing structure having an adjustable gas outlet, said outlet housing structure further in communication with the exterior of said inlet housing structure, said outlet housing structure having a main chamber and a secondary chamber wherein said flow of gas exiting said drying chamber can be divided into a main flow of gas passing from said main chamber to said inlet housing structure and a secondary flow of gas passing from said secondary chamber past a condenser located in said secondary chamber to said inlet housing structure.

10. A dryer, particularly for the chemical industry, comprising:

a housing having a right parallelepipedal drying chamber, at least one loading car fitting flush within said drying chamber, a ventilator having an exhaust side chamber, said ventilator being disposed in a ceiling portion of said dryer housing along with a heater and a condenser, said housing including a distributing device for the flow of gas led past said loading car, said drying chamber, and said ceiling portion of said housing, said flow of gas being dividable into a main flow led past said heater and a secondary flow led past said condenser, said ceiling portion of said housing including a dividing chamber being sub-divided into a main chamber, having said main flow of gas therethrough, and a secondary chamber, having said secondary flow of gas therethrough, said main and secondary chambers being provided on the suction side of said ventilator and having respective inlets and outlets, said condenser being accommodated in said secondary chamber, at least one inlet of said main and secondary chambers including a controllable valve for controlling the flow of gas to said main and secondary chambers, said heater being positioned in said exhaust side chamber in said ceiling portion of said dryer, said outlets and inlets of said main and secondary chambers as well as said exhaust side chamber being connected with side chambers in said housing having the height of said loading car, said side chambers having side walls forming part of said drying chamber and having perforations therethrough for the flow of gas.

* * * * *